United States Patent [19]

Juillard et al.

[11] 4,003,818

[45] Jan. 18, 1977

[54] METHOD OF OBTAINING A MICRO-POROUS MEMBRANE AND NOVEL PRODUCT THUS OBTAINED

[75] Inventors: Michel Juillard, Orsay; Pierre Bouy, Enghein-les-Bains, both of France

[73] Assignee: Rhone-Poulenc Industries, Paris, France

[22] Filed: July 31, 1975

[21] Appl. No.: 600,219

[30] Foreign Application Priority Data

Feb. 8, 1974 France ..... 74.26922

[52] U.S. Cl. ..... 204/296; 264/49; 264/127; 264/140

[51] Int. Cl.[2] ..... B29D 27/08; C25B 13/08

[58] Field of Search ..... 264/49, 127, 140; 204/296

[56] References Cited

UNITED STATES PATENTS

| | | | |
|---|---|---|---|
| 2,728,698 | 12/1955 | Rudner | 264/49 X |
| 2,997,448 | 8/1961 | Hochberg | 264/49 X |
| 3,281,511 | 10/1966 | Goldsmith | 264/49 |
| 3,518,332 | 6/1970 | Sklarchuk et al. | 264/49 |
| 3,556,161 | 1/1971 | Roberts | 264/49 X |
| 3,661,645 | 5/1972 | Strier et al. | 264/49 X |
| 3,773,878 | 11/1973 | Jahnke | 264/49 |
| 3,890,417 | 6/1975 | Vallance | 264/49 |

OTHER PUBLICATIONS

*Hackh's Chemical Dictionary*, Fourth Edition, Completely Revised and Edited by Julius Grant, New York, McGraw-Hill, c1972, p. 281.

*Encyclopedia of Polymer Science and Technology*, vol. 3, Section: "Characterization of Polymers," New York, Interscience, c1965, pp. 620–621.

*Encyclopedia of Polymer Science and Technology*, vol. 13, Section: "Tetrafluoroethylene Polymers," New York, Interscience, c1970, pp. 639–645.

*Primary Examiner*—Philip Anderson

[57] ABSTRACT

A method of obtaining a micro-porous membrane is provided as well as the improved membrane. Said method is characterized in that a homogeneous paste is prepared from a pore-forming filler substance and a latex, and said paste, which is reduced to powder form, is dried and a membrane is formed therefrom and then (fritted) sintered, and the pore-forming filler substance is then removed. The membrane thus obtained is particularly useful as a diaphragm for electrolysis cells.

10 Claims, No Drawings

METHOD OF OBTAINING A MICRO-POROUS MEMBRANE AND NOVEL PRODUCT THUS OBTAINED

BACKGROUND OF THE INVENTION

The present invention relates to a method of producing a micro-porous membrane and to the membrane so obtained. More particularly, the invention is concerned with a diaphragm intended for use in electrolysis cells.

Although diaphragm-type cells have been known for many years, the effect of the diaphragm has not been clearly explained. The old explanation, according to which the diaphragm acts as a filter bed and according to which the flow of the brine and the migration of the ions can be calculated when the number of pores and their means diameter are known, appears to be an over-simplification as observed by J. S. Sconce in "Chlorine, Its Manufacture, Properties and Uses," American Chemical Society—Monograph Series No. 154, page 105, 1962.

In the absence of a satisfactory explanation, it has been found that such diaphragms should have quite conflicting properties. In particular, they should have a large proportion of cavities but at the same time they should possess adequate mechanical strength. Furthermore, their configuration should be such that good diffusion of the brine takes place, while at the same time the solutions in the anode and cathode compartments are sufficiently retained, the formation of chlorate in particular being avoided. Numerous methods have already been proposed for obtaining these diaphragms.

For some time the tendency has been towards diaphragms based on an asbestos suspension which could be deposited directly on a cathode. However, the renewal of interest in other types of cells, such as those known as the filter-press type, has directed interest towards prefabricated diaphragms. These cells, however, have been found to impose particularly stringent requirements as regards the diaphragms. On the one hand, the diaphragms are required to be very reliable and to have an increased service-life. However, it is known that the diaphragms tend to age, that is to say, their porosity, for example, diminishes with the passage of time.

This requirement as regards reliability and long service-life is also accompanied by a need for good electrical properties in view of the fact that the present trend is towards increasing current density. Diaphragms consisting essentially of asbestos fibers have, however, only led to structures whose porosity is difficult to control. Furthermore, they suffer from the same disadvantages as non-consolidated structures, namely:

- swelling during electrolysis, this requiring a minimum interpolar distance;
- difficulties in obtaining thin deposits characterized by a low ohmic loss; and
- an unstable condition of the diaphragm which, after commencement of electrolysis and stabilization renders it very difficult to deal with breakdowns during operations and to effect repairs or replacements in situ.

It is for these reasons that, over a number of years, there has been a tendency to use plastic porous diaphragms constituted by membranes made of a porous material. Such materials are known per se.

It has been proposed, for example, to make diaphragms by (fritting) sintering polytetrafluoroethylene powder with a pore-forming material, (fritting) sintering being carried out at 380° C. and the pore-forming material then being removed. Unfortunately, such a method results in a material which has a low proportion of cavities and which nevertheless has excessively great electrical resistance.

Also, British Pat. No. 1,081,046 discloses the idea of forming a coagulum from an aqueous polytetrafluoroethylene dispersion containing a filler substance, of then forming a sheet therefrom, and of finally removing the filler substance. This, however, does not solve the problem of shaping the coagulum. It was proposed to facilitate shaping by using a lubricant such as petroleum ether.

Unfortunately, this method suffers from the disadvantage that it does not provide reproducible results; for this reason, French Pat. No. 2,170,247 proposes the substitution of water for petroleum ether.

Numerous other disclosures are to be found relating to prior art diaphragms. Mention may be made to the following patents which employ techniques of compression preforming followed by (fritting) sintering, or techniques of coagulation of the mixture or depositing of this mixture on a support.

Thus, French Pat. No. 1,491,033 of Aug. 31, 1966, describes a process for manufacturing a porous diaphragm which consists in the sequence of: (1) mixing a solid additive in particulate form into an aqueous dispersion of polytetrafluoroethylene in the presence of particulate inorganic fillers, (2) then coagulating the dispersion, (3) placing the resulting coagulum in sheet form, and (4) finally removing the solid particulate additive from the sheet. The additive consists of starch or calcium carbonate and is removed at the end of the operation by immersing the resultant sheet in hydrochloric acid to dissolve the additive. The particulate inorganic fillers which are suitable are barium sulfate, titanium dioxide or powdered asbestos. They are used in proportions of between 40 and 70% of the weight of polytetrafluoroethylene contained in the dispersion.

British Pat. No. 943,624 of Dec. 14, 1961, proposes a method of producing a filter material which consists in mixing polytetrafluoroethylene in powder form with an eliminatable powdered material, subjecting the mixture to preforming under high pressure, and then sintering the resultant shape at a temperature which does not affect the polymer, the powdered material being eliminated either by volatilization at the sintering temperature or by the addition of solvents in which it is solubilized.

German application No. 2,140,714 of Aug. 13, 1971 describes a process of manufacturing diaphragms having a base of inorganic fibers, particularly asbestos, which are bonded by a fluorinated resin. The membrane can be obtained by impregnating a paper or fabric, or else produced by the introduction of fibers into the resin suspension and shaping in accordance with a paper-making method. The sintering is then effected under elevated pressure.

All of these foregoing prior art techniques, however, have a number of drawbacks, namely:

1. Providing flat diaphragms only, either because the use of calendering or pressing makes any other shapes impossible, or that the initial suspensions, in particular when they are coagulated, do not have sufficient properties to permit homogeneous deposits on supports of complex shape.

2. Difficulties, in the case of membranes rich in polytetrafluoroethylene, in producing membranes of satisfactory mechanical properties (permitting large flow) and of good wettability, 3. Low percentage of voids is permitted in the diaphragm structure. In order to obtain good mechanical properties and excellent conservation of the cohesion during electrolysis, the quantities of pore-forming agents used are zero or low, namely, 200–300%, or less, by weight of material. Under these circumstances, the performances in the electrolysis of sodium chloride are not truly of interest—rather large ohmic drop or low Faraday yield, resulting from the reduced porosity of the diaphragm.

Other prior art is also less than satisfactory. British Pat. No. 1,160,084, published July 30, 1969, discloses membranes and diaphragms produced from a matrix of a fluorocarbon polymer and a combustible fibrous substrate, such as of cellulose, which can be burned out of the matrix. The resulting product is porous in nature, due to the voids left by the burning of the cellulose. According to the patent, asbestos in the diaphragm is to be avoided.

British Pat. No. 1,063,244, published Mar. 30, 1967, describes a porous medium which is unsuitable for use in electrolysis cells. It is comprised of a porous base, such as of paper, having fibers, such as of asbestos, adhered to the surface, with the aid of a polymeric binder.

Bachot et al. U.S. patent application Ser. No. 469,808, filed May 14, 1974, and assigned to the assignee of the present application discloses a method which consists in forming an asbestos suspension in the presence of a surface-active agent and in adding to this suspension the latex of the fluorinated hydrocarbon resin and the pore-forming material. Although such a method gives good results and, in particular, enables a large quantity of pore-forming agent to be introduced, it still requires a certain proportion of asbestos and the use of a wet process.

It has now been found that it is possible to obtain porous membranes particularly suitable for use as diaphragms in electrolysis, using a technique which can be regarded as a dry method, and it is this method that forms the subject matter of the present invention.

It is, therefore, an object of the present invention to provide an improved dry method of producing a microporous membrane.

It is another object to provide an improved microporous membrane suitable for use in electrolysis cells.

Other objects will be apparent to those skilled in the art from the present description.

General Description of the Invention

The method of the present invention consists in:

1. forming a homogeneous paste from a pore-forming charge or filler material and a latex;
2. drying the paste obtained and then reducing it to powder form;
3. hot-rolling a preformed product obtained from said powder;
4. (fritting) sintering the membrane thus obtained; and
5. finally, removing the pore-forming material.

The pore-forming material used may be calcium carbonate, colloidal alumina, metallic oxides or any products capable of being removed by a solvent or by chemical decomposition on completion of operations.

The particle size will depend upon the required properties of the membrane and the performance required of the diaphragm. In the case of calcium carbonate, a particle size of from about 2 to 20 microns in advantageously used.

The latex employed should be such that it meets the requirements imposed in electrolysis, and in practice it is constituted by a polytetrafluoroethylene latex in water, advantageously in amounts of from about 40 to 80% as dry extract. Use could be made of other fluorinated polymeric resin latexes (a copolymer of tetrafluoroethylene and hexafluoroethylene, polychlorotrifluoroethylene, etc.).

Advantageously, the starting composition is obtained by mixing, accompanied by rapid stirring, 3 to 10 parts of pore-forming material with about 0.1 to 0.5 parts of water, then adding thereto 1 part of latex (calculated as dry extract).

The composition obtained is then dried by moderate thermal action, for example, by evaporation on a stove, at temperatures of from about 80° to 120° C. over periods of from about 4 to 10 hours, the material then being reduced to a powder. Drying is carried out to obtain a slightly tacky powder preferably containing about 0.1 to 1% of water.

A preformed product is then prepared and this is subjected to treatment at a somewhat higher temperature than the first, advantageously at a temperature of between about 100° and 180° C. over a period of between about 0.5 and 2 hours. Said preshaped product is then rolled at a temperature of between about 130° C. and 180° C.

Optionally, a layer of the product thus obtained is applied to a support such as a grid which may be of woven form.

The material is then subjected to a (fritting) sintering operation at a temperature preferably higher than the crystalline melting point of the fluorinated polymer, and in the case of polytetrafluoroethylene, (fritting) sintering is advantageously carried out at temperature of between about 330° C. and 360° C. for a quite short period of between about 2 and 20 min., and preferably between about 3 and 15 min.

After the diaphragm has been allowed to cool, it is immersed in an aqueous solution containing about 5 to 30% by weight of a weak acid for a period of between about 24 hours and 15 days, depending upon the thickness. Use is preferably made of acetic acid, but other weak acids can be used with equal success. The purpose of this treatment is to extract the calcium carbonate and form pores in the membrane. When the pore-forming filler materials are employed, other solvents may be used for their extraction. Thus, for alumina, the solvent is desirably a solution of sodium hydroxide or other alkali.

The diaphragm is then washed with water, degassed and wetted. The degassing can be carried out, for example, by immersion in methyl alcohol and then in water.

The present invention also concerns the product obtained by the above method. The diaphragms in accordance with the invention are remarkable for their good mechanical properties combined with good electrical properties. Thus, the high proportion of cavities enabling good permeability to be achieved, low relative resistance and good electrolytic behavior are allied with considerable mechanical strength, particularly tensile strength and elongation.

SPECIFIC DESCRIPTION OF THE INVENTION

The present invention will be more fully understood with the aid of the following examples provided by way of illustration only and not of limitation.

EXAMPLE 1

There were introduced into a high-speed mixer, 130 cubic centimeters of water and 4800 grams of a charge or filler material consisting of calcium carbonate having a mean particle size of 5 microns and marketed under the trademark OMYA-BLE, and 1000 grams of polytetrafluoroethylene—60% dry extract—were then added to this mixture.

The mixture was then spread out on a smooth surface to form a flat cake which was dried in a stove at 100° C. for 6 hours. The cake was then crushed and the powder product, which was still slightly tacky, was preformed and subjected to a first heat treatment at 170° C. to obtain a sheet having a thickness of 2mm. After rolling, a metal-wire mesh representing a proportion of cavities of 72% was introduced into the sheet.

The structure was then (fritted) sintered at 350° C. for 8 min., the carrier substance then being eliminated by immersion in a water bath containing 20% of acetic acid, during a period of 10 days.

Degassing and wetting were carried out by immersion in water, treatment in methyl alcohol and then washing in a vacuum of 700 mm. Hg.

The diaphragm thus obtained had a permeability of 0.10 cm.$^3$/min. cm.$^2$, and a relative resistance R/Ro of 25. Permeability corresponds to the delivery expressed in cm.$^3$ per minute per cm.$^2$, of diaphragm, under a pressure of 54 g./cm.$^3$.

The term "relative resistance," as used herein, means the quotient of the resistance of a medium constituted by the diaphragm soaked in electrolyte in relation to the resistance of the medium constituted solely by the same electrolyte.

Furthermore, the diaphragm had a tensile strength of 3 $MP_a$.

EXAMPLES 2, 3, 4 and 5

The purpose of these Examples is to bring out the effect of the (fritting) sintering treatment.

The operating conditions were the same except that the (fritting) sintering time and (fritting) sintering temperature were varied. Tensile strength was measured and is shown in $MP_a$ in the following Table.

| EXAMPLES | Time in min. | Temperature in ° C. 335 | 350 | 365 | 380 |
|---|---|---|---|---|---|
| 2 | 7 | 3.4 | 3.4 | 3.4 | 2.3 |
| 3 | 5 | 4 | 3 | 3 | 2 |
| 4 | 7 | 3.8 | 3 | 2.8 | 1.3 |
| 5 | 15 | 3.8 | 3.5 | 2.5 | 0.5 |

These Examples show that the mechanical properties of the membrane obtained are particularly good, but they also show that the (fritting) sintering time and (fritting) sintering temperature are not very critical.

EXAMPLES 6 to 8

For the following Examples, the same conditions as before were used, except that the proportions of the constituent materials were varied, as well as the thickness *e* of the product, expressed in mm.

The membranes obtained were tested in a cell of the filter-press type having an iron cathode and a metal anode, and using a current density of 25 A/dm$^2$. The results obtained are given below, a mean value being shown for each factor.

| EXAMPLES | Filler or charge materials: parts per 100 parts PTFE* | e (mm) | R/Ro | U** in cm$^3$/min. × cm$^2$ | Results of electrolysis test: Voltage (V) | Propn. of chlorate (g/l) | Propn. of soda (g/l) |
|---|---|---|---|---|---|---|---|
| 6 | 400 | 1.4 | 3.3 | 0.36 | 3.2 | 0.3 | 120 |
| 7 | 600 | 1.2 | 2.6 | 0.08 | 3.4 | 0.6 | 115 |
| 8 | 800 | 1.2 | 2.1 | 0.05 | 3.3 | 0.6 | 120 |

*PTFE = polytetrafluoroethylene
**Permeability

EXAMPLES 9 and 10

The object of these Examples is to bring out the effect of the particle size of the charge material.

The operating conditions were the same as previously, and the charge proportion was 800 parts of calcium carbonate per 100 parts of polytetrafluoroethylene. The results obtained are shown in the Table below:

| EXAMPLES | Mean Particle size (microns) | e (mm) | R/Ro | U in cm$^2$/min. × cm$^2$ | Results of electrolysis tests: Voltage (V) | Propn. of chlorate (g/l) | Propn. of soda (g/l) |
|---|---|---|---|---|---|---|---|
| 9 | 5 | 0.85 | 2.4 | 0.12 | 3.2 | 1.1 | 120 |
| 10 | 20 | 0.85 | 2.8 | 0.40 | 3.1 | 1.5 | 110 |

These two Examples show that it is of advantage to use a fairly small particle size.

EXAMPLE 11

For this Example, all the conditions were the same as in Example 1, except as regards the thickness of the membrane which was 1.6 mm.

The membrane obtained, which had a permeability of 0.03 $cm.^3/min. \times cm.^2$ and a relative resistance of 2.3, was subjected to electrolysis tests using a higher current density of 30 $A/dm^2$.

The equilibrium voltage was 3.48 volts, the proportion of chlorate 0.60 g./l. with a proportion of soda of 120 g./l., and the pressure on the diaphragm was 17 cm. of water.

In particular, it was found that the pressure on the diaphragm reached the above value very rapidly and then remained constant with the passage of time.

The above Examples, which in no way limit the scope of the invention, demonstrate the advantages of the invention which enables two largely imcompatible requirements to be met, namely, good electrical behavior and high mechanical strength.

Surprisingly, these results were obtained on the basis of a method using a dry technique and fritting which hitherto had been considered in the prior art as being incapable of leading to a sufficiently great proportion of cavities, that is to say, to a degree of permeability satisfactory for enabling such membranes to be used as electrolysis diaphragms.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A method of producing a micro-porous membrane, characterized in that a homogeneous paste is first formed from a pore-forming particulate filler material and a latex of a fluorinated polymeric resin, said paste is dried in order to obtain a material containing between about 0.1 and 1% of water and the resulting material is reduced to powder form, the product so obtained is preformed and a membrane is formed by rolling said preform, the membrane thus obtained is sintered and the pore-forming particulate filler material removed.

2. A method of producing a micro-porous membrane according to claim 1, wherein the pore-forming particulate filler material is calcium carbonate.

3. A method according to claim 2, wherein the calcium carbonate has a particle size of between about 2 and 20 microns.

4. A method of obtaining a micro-porous membrane according to claim 1, wherein the latex is an aqueous dispersion of polytetrafluoroethylene.

5. A method according to claim 4, wherein the aqueous dispersion contains between about 40 and 80% polytetrafluoroethylene.

6. A method of obtaining a micro-porous membrane according to claim 1, wherein, for each part by weight of latex, there are employed from about 3 to 10 parts of pore-forming filler material and about 0.1 to 0.5 of a part of water.

7. A method of obtaining a micro-porous membrane according to claim 1, wherein the homogeneous paste, comprising the particulate pore forming filler material calcium carbonate and polytetrafluoroethylene, is dried, after mixing, at a temperature of about 80° to 120° C. for a period of about 4 to 10 hours so as to obtain a product containing 0.1 to 1% of water, a preformed product is formed which is subjected to heat treatment at a temperature of between about 150° and 180° C. for a period of between about 0.5 and 2 hours, whereafter said preformed product is rolled at a temperature of between about 130° and 180° C., the membrane thus obtained is subjected to a sintering operation at a temperature of between about 330° and 365° C. for a period of between about 2 and 20 min., the pore-forming filler material is then removed by immersion in an aqueous solution containing about 20 to 30% by weight of a weak acid for a period of between about 24 hours and 15 days, and the micro-porous membrane is subjected to a degassing and wetting treatment.

8. A method of obtaining a micro-porous membrane according to claim 7, wherein wetting is carried out in methyl alcohol.

9. A method of obtaining a micro-porous membrane according to claim 1, wherein, prior to the sintering operation, the membrane obtained from the rolling operation is placed as a layer on a permeable reinforcing support.

10. A micro-porous membrane for use in electrolysis made by the process of claim 1.

* * * * *